United States Patent [19]

Claycomb

[11] Patent Number: 5,016,921

[45] Date of Patent: May 21, 1991

[54] DURABLE BLAST JOINT WITH HYDROSTATIC DRIVER

[76] Inventor: Jack R. Claycomb, 8226 Waynemer, Houston, Tex. 77040

[21] Appl. No.: 493,300

[22] Filed: Mar. 14, 1990

[51] Int. Cl.[5] ..... F16L 35/00

[52] U.S. Cl. ..... 285/39; 285/45; 285/321; 285/328; 166/243

[58] Field of Search ..... 166/243; 285/321, 45, 285/39, 83, 328, 306, 422, 900

[56] References Cited

U.S. PATENT DOCUMENTS

| | | | |
|---|---|---|---|
| 3,895,832 | 7/1975 | Ellis et al. | 285/322 |
| 4,028,796 | 6/1977 | Bergstrom | 29/416 |
| 4,141,386 | 2/1979 | Bergstrom | 138/147 |
| 4,211,440 | 7/1980 | Bergstrom | 285/45 |
| 4,349,050 | 9/1982 | Bergstrom et al. | 138/147 |
| 4,381,821 | 5/1983 | Greene, Jr. | 166/243 |
| 4,613,165 | 9/1986 | Kuhne | 285/45 |
| 4,685,518 | 8/1987 | Claycomb | 166/243 |
| 4,726,423 | 2/1988 | Claycomb | 166/380 |
| 4,889,185 | 12/1989 | Uherek et al. | 166/243 |
| 4,911,479 | 3/1990 | Claycomb | 285/39 |
| 4,915,177 | 4/1990 | Claycomb | 166/380 |

*Primary Examiner*—Peter M. Cuomo
*Assistant Examiner*—Tim Aberle
*Attorney, Agent, or Firm*—Pravel, Gambrell, Hewitt, Kimball & Krieger

[57] ABSTRACT

A durable blast joint using a protective sheath of erosion resistant rings arranged in overlapping stacks so as to provide a vertically continuous protective sheath for the full length of the blast joint. The blast joint provides durable structural surfaces suitable for gripping with power tools and has a pressure operated hydrostatic driver for maintaining a tight fit between a continuous series of erosion resistant rings. The blast joint is also adaptable to be installed in a pressurized well, using a snubber unit.

8 Claims, 4 Drawing Sheets

DURABLE BLAST JOINT WITH HYDROSTATIC DRIVER

FIELD OF THE INVENTION

This invention is in the field of blast joints suitable for service in production zones where the joint will be subjected to high speed particle impingement.

BACKGROUND OF THE INVENTION

In the drilling and production of oil and gas wells it is frequently necessary to penetrate one or more production zones to reach an underlying zone with production tubing. Each production zone is served by its own string of production tubing which then must penetrate the overlying production zones to reach the surface. At the point where each string of production tubing penetrates an overlying production zone, the tubing can be subjected to severe erosion.

Particularly where the production zone being penetrated produces high pressure gas, abrasive materials entrained in the gas can quickly erode the surface of the production tubing penetrating that zone. High pressure gas moves at very high velocities when the zone is producing and it can contain such entrained erosive materials as grains of sand or drops of liquid. Where the high velocity gas enters the well bore, it impinges upon the penetrating production tubing from an underlying zone and, depending upon the material from which the production tubing is made, the high velocity gas can quickly damage or even penetrate the wall of the production tubing.

When the wall of the production tubing has been penetrated in an overlying zone, communication is established between two different production zones through the failed production tubing string. Communication between zones can be highly undesirable, and isolation between the zones must be maintained. Isolation between the zones in the well bore is generally obtained by the use of packers about the production tubing between production zones. When erosion of production tubing has reached an advanced state it becomes necessary to replace the eroded section or sections of tubing. This requires removing the production tubing string from the well bore, replacing the failed joints of tubing and reinserting the tubing string into the well bore along with any necessary replacement of packers.

Different tubing materials will erode at different rates and to different degrees depending upon the velocity of the impinging fluid as well as the type and amount of abrasive materials entrained in the fluid. Some materials are considered highly erosion resistant, and various methods have been used to incorporate these materials into the design of the production tubing where the tubing must penetrate overlying producing zones. Joints of pipe or tubing have been designed which incorporate a jacket of a highly erosion resistant material, such as tungsten carbide, over the production tubing. Various methods are used to insure that the tungsten carbide will surround the tubing at the areas where the high velocity fluid enters the well bore. The tungsten carbide is generally installed in stacks of relatively short rings and held in place longitudinally by various types of sleeves and collars. In some designs the rings are kept pressed together by the installation of a spring, such as a coil spring, around the tubing to press against the end of one of the tungsten carbide rings.

A major problem with the use of a highly erosion resistant material, such as tungsten carbide, is that such materials, while being very hard, are also very brittle and therefore subject to damage when placed under radial or axial loads. When making up a tubing string for insertion into a well, it is necessary to support the top joint on the string at the well head and to hold that joint against rotation while threading the next joint to the top joint of the string. Power tongs or similar tools are normally used to thread the two joints together. The top joint of the tubing string is held against rotation while the power tongs rotate the next joint being installed. Such power equipment necessarily bites into the surface of the tubing joint in order to apply the necessary torque to either hold the joint against rotation or to rotate the joint in making up the thread. If such power tools are used on a surface of the blast joint where the erosion resistant material, such as tungsten carbide, is exposed, the torque is not efficiently transferred to the tubing and the tungsten carbide rings can easily become chipped and cracked, resulting in a loss of protection against abrasion once placed into service in a production zone.

Another operation frequently encountered which can result in damage to the tungsten carbide rings is the gripping of a blast joint from above with pipe slips having upwardly canted internal teeth. These teeth must necessarily dig into the surface of the joint to achieve their gripping action in order to pull the blast joint or other piece of equipment out of the well bore. Gripping of a blast joint by such a slip, if the slip teeth contact the tungsten carbide rings, can result in cracking or breaking of the rings as mentioned before in the case of power tongs, by the application of radial or axial forces, through the slip teeth.

Some blast joints, using tungsten carbide rings, incorporate thin metal sleeves on the outside of the tungsten carbide rings, but these sleeves are of insufficient strength to withstand the radial and axial stresses imparted by power tools, and the sleeves typically are not mounted to the inner production tubing with sufficient mechanical strength to transfer the necessary torque or axial force to the tubing itself. These thin sleeves are generally only effective at protecting the tungsten carbide rings during assembly and handling which does not involve the use of the aforementioned power tools.

Another disadvantage of blast joints having exterior carbide rings occurs when the operator wishes to insert the blast joint through a snubber unit. A snubber unit allows a pressurized well to be reworked without first plugging or killing the well. Killing the well is undesirable because it can be difficult and expensive to resume production from a well that has been killed. The snubber unit is mounted on the wellhead of a well which is to be reworked under pressure. The snubber unit establishes and maintains a pressure seal around the tubular goods coming out of or going into the well at the wellhead. It is typically mounted atop one or more blowout preventers. In addition to maintaining the pressure seal, the snubber unit grips any tubular goods being inserted and forces them into the well against the wellhead pressure, which can approach several thousand pounds per square inch. Alternatively, the snubber unit can be used to grip a tubular good being extracted from the well to limit or control its outward movement under wellhead pressure.

This gripping of the tubular goods can be accomplished by pipe slips or other devices which place highly concentrated mechanical loads on the goods being gripped. In addition, the pressure seal can only be effective if applied to a relatively smooth surface which is capable of maintaining its pressure integrity under the pressures experienced at the wellhead. It can be seen then, that a typical carbide blast joint can not be inserted into a well with a snubber unit. If this were attempted, the carbide rings would immediately deteriorate or even fail completely, and the pressure seal could not be maintained. A very expensive and dangerous blowout would occur. For this reason, whenever it has been necessary to insert a blast joint during rework of a well, the well has been killed, rather than using a snubber unit.

Presently known blast joints, therefore, in addition to being very expensive, are somewhat fragile, and they cannot be installed in a string of production tubing as if they were simply another joint of production tubing. It is desirable to design a blast joint which provides protection against erosion for its full length without any gaps, but which can be handled by the use of power tongs and pipe slips without any unusual degradation of the joint. It is further desirable to design such a blast joint which can be threaded into place in a production tubing string as if it were simply another joint of production tubing, either as a single joint or as a string of consecutive joints having a continuous protective sheath of tungsten carbide rings without any gaps in between. Additionally, it is further desirable to design such a blast joint which can be used with a snubber unit.

SUMMARY OF THE INVENTION

This invention is a blast joint which can be handled as a normal section of production tubing or pipe using power tongs, pipe slips, or other power equipment, but which exhibits a continuous protective sheath of erosion resistant material for essentially its full length. A lower housing is provided on the blast joint of this invention which can be handled using power tongs and which provides erosion resistance by using overlapping stacks of erosion resistant rings for its full length.

This invention further includes an upper housing which incorporates a slip skirt suitable for gripping with slip teeth and a tongs skirt suitable for gripping with power tongs. The upper housing also includes overlapping stacks of erosion resistant rings for its full length. The lower and upper housings are mounted on an inner joint of production pipe or tubing in order to impart thereto the axial and radial loads and the torque as required to make up the blast joint of this invention with adjacent tubing joints or blast joints. The overlapping stacks of erosion resistant rings run continuously from near the lower threaded end of the inner pipe joint to above the upper threaded end of the inner pipe joint so as to create a continuous protective sheath of erosion resistant material for the full length of a string of successive blast joints.

This invention further includes a pressure operated hydrostatic driver for maintaining zero clearance between a continuous series of erosion resistant rings by taking advantage of the well pressure to operate the hydrostatic driver.

Additionally, this invention further includes a snubbing pressure jacket which is adapted to connect to the lower end of the upper housing. The snubbing pressure jacket provides a continuous uniform surface which can be gripped by the snubber unit without gripping or damaging the carbide rings.

DETAILED DESCRIPTION OF THE INVENTION

Figure 1A:
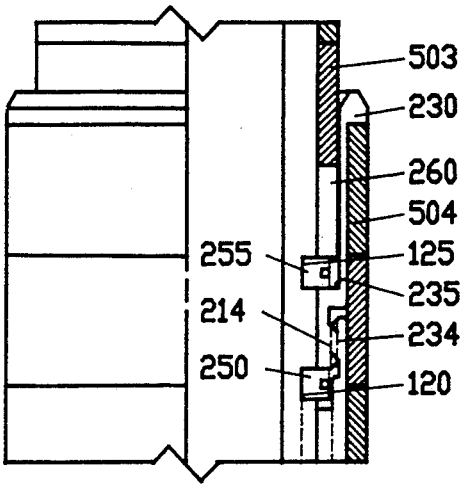
FIG. 1*a* is an enlarged partial cross-section of the upper portion of the lower housing shown in FIG. 1.
Figure 1B:
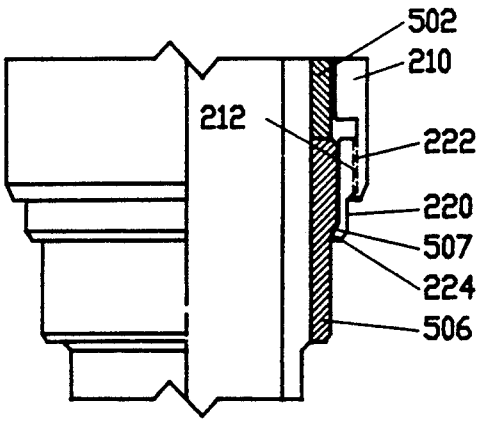
FIG. 1*b* is an enlarged partial cross-section of the lower portion of the lower housing shown in FIG. 1.

A detailed description of the preferred embodiment of the invention will now be given, illustrated in the drawings as applied to a particular type of drill pipe. It will be understood that this invention can easily be adapted to any size or type of drill pipe or tubing.

Figure 1:
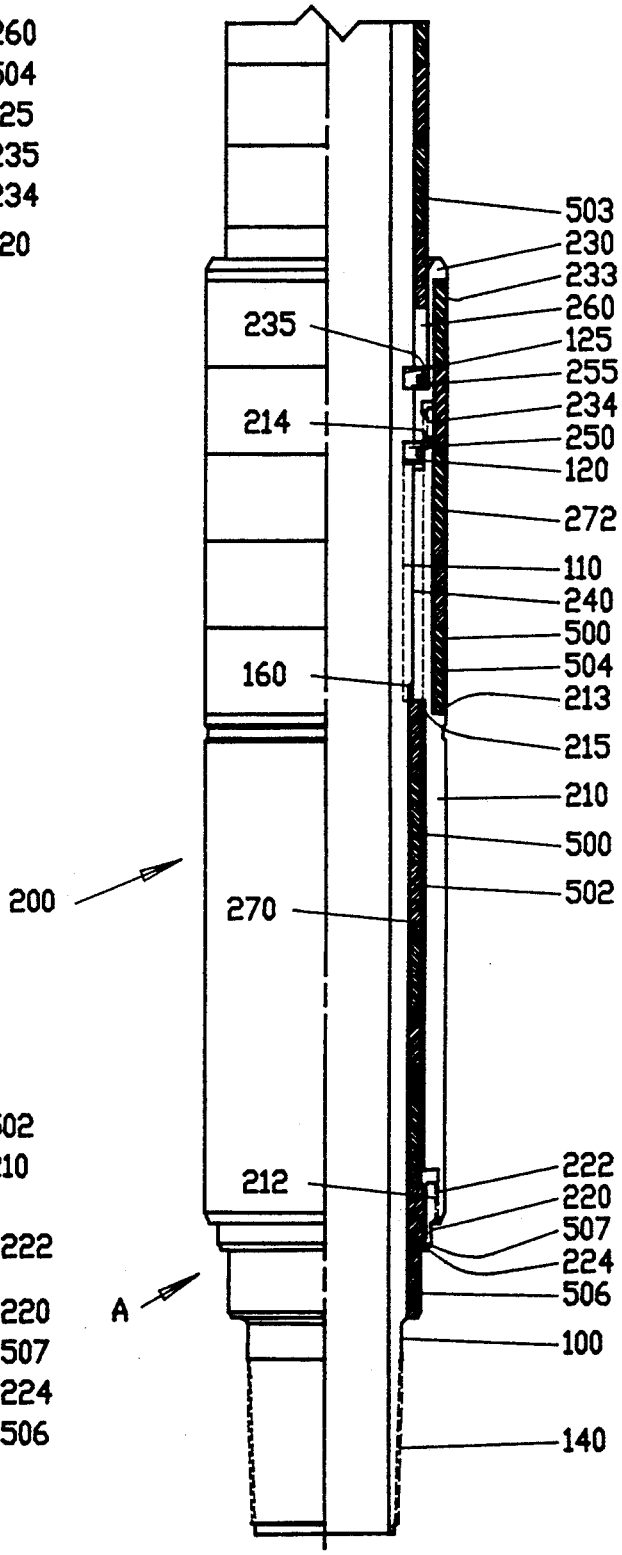
FIG. 1 is a partial cross-section of the lower end of the blast joint of the present invention showing the lower housing.

As shown in FIG. 1, blast joint A incorporates at its innermost diameter inner pipe 100. Blast protection of this pipe 100 is achieved by applying a protective sheath which incorporates two types of housings. Shown in FIG. 1 is lower housing 200. Lower housing 200 consists of lower housing body 210, lower housing end sleeve 220 and lower housing locking collar 230. End sleeve 220 is fastened to body 210 by the engagement of lower housing end sleeve threads 222 and body lower threads 212. Lower housing body 210 is fastened to lower housing locking collar 230 by the engagement of body upper threads 214 and locking collar threads 234. Inner pipe 100 has machined into its outer surface a plurality of longitudinal spline grooves 110 and first and second annular split ring grooves 120 and 125 respectively. A plurality of splines 240 lie in spline grooves 110, partially protruding therefrom into matching longitudinal grooves in lower housing body 210. Similarly, first lower housing retainer split ring 250 lies in the first split ring groove 120, partially protruding therefrom into a matching recess in lower housing body 210. A second lower housing retainer split ring 255 lies in the second split ring groove 125, partially protruding therefrom into a matching recess in lower housing locking collar 230. Splines 240 prevent lower housing 200 from angular movement or rotation relative to inner pipe 100. First and second retainer split rings 250 and 255 prevent lower housing 200 from moving longitudinally relative to inner pipe 100.

Lower housing 200 serves to hold in place and protect a plurality of erosion resistant rings 500 made of a hard material such as tungsten carbide. Erosion resistant rings 500 are arranged in vertical stacks concentric with inner pipe 100 so that successive stacks overlap one another at their ends. This results in a vertically continuous protective sheath of erosion resistant rings 500 from a point below lower housing 200 to a point above lower housing 200 without leaving a vertical gap between any of the erosion resistant rings 500. In order to accomplish this overlapping arrangement, the majority of rings 500 have one of three different diameters, with small diameter rings 502 lying directly on the outer surface of inner pipe 100 at the lower end, medium diameter rings 503 lying directly on the outer surface of inner pipe 100 in the area generally between lower housing 200 and upper housing 400 (see FIG. 2), and large diameter rings 504 lying radially outward from small and medium diameter rings 502 and 503 respectively. The thickness and vertical length of erosion resistant rings 500 can be varied as desired, with a standard length being between one and one/half inch and two inches. In addition to the small, medium and large diameter rings 502, 503 and 504 respectively, certain specially shaped rings are used at particular points in blast joint A. The first example is lower end ring 506 which has the same inner diameter as the small diameter rings 502 in order to conform closely to the outer surface of the lower end of inner pipe 100, which as shown here, has a lower shoulder 160 immediately above the lower end of the spline grooves 110. Lower end ring 506 also has, on its external surface, shoulder 507 which enables lower end ring 506 to be held in place by lower housing end sleeve 220, which captures lower end ring 506 by means of lower end ring lip 224. This arrangement of lower end ring 506 extending beyond end sleeve 220 makes possible the overlapping of erosion resistant rings 500 with similar rings found at the upper end of the next lower blast joint, if assembled.

Lower housing body 210 has an internal annular recess 270 and an external annular recess 272 in which erosion resistant rings 500 are arranged abutting internal recess shoulder 215 and external recess shoulder 213. Lower housing locking collar 230 also has internal and external annular recesses in which erosion resistant rings 500 are arranged in an overlapping fashion. Large diameter rings 504 abut external recess shoulder 233 while medium diameter rings 503 can abut second internal split ring 255, or as shown, interposed therebetween can be spacer ring 260. Spacer ring 260, preferably made of steel, is appropriately sized as required in make-up of blast joint A to achieve the desired overall length of the stack of erosion resistant rings 500. If it is used, spacer ring 260 must have a short enough vertical length to insure that overlap exists between the stacks of medium diameter rings 503 and large diameter rings 504 at the upper end of lower housing 200.

Figure 2A:
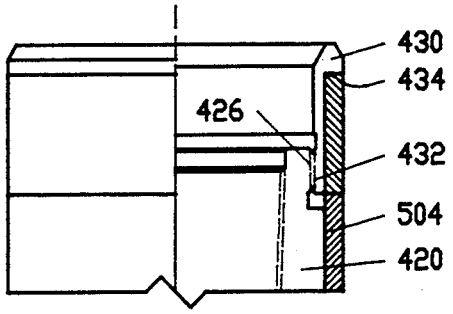
FIG. 2*a* is an enlarged partial cross-section of the upper portion of the upper housing shown in FIG. 2.
Figure 2:
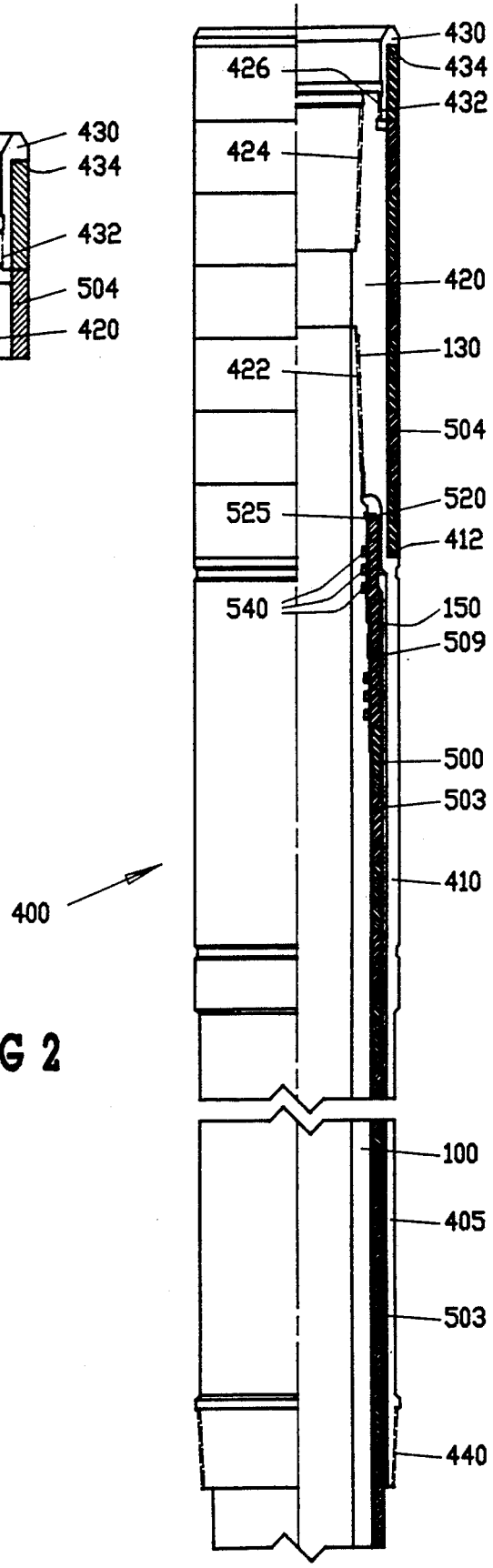
FIG. 2 is a partial cross-section of the upper end of the blast joint of the present invention showing the upper housing.

It should be noted that a stack of medium diameter rings 503 extends from the upper end of lower housing 200 and that this stack continues without interruption to the lower end of upper housing 400 as shown in FIG. 2.

Figure 3:
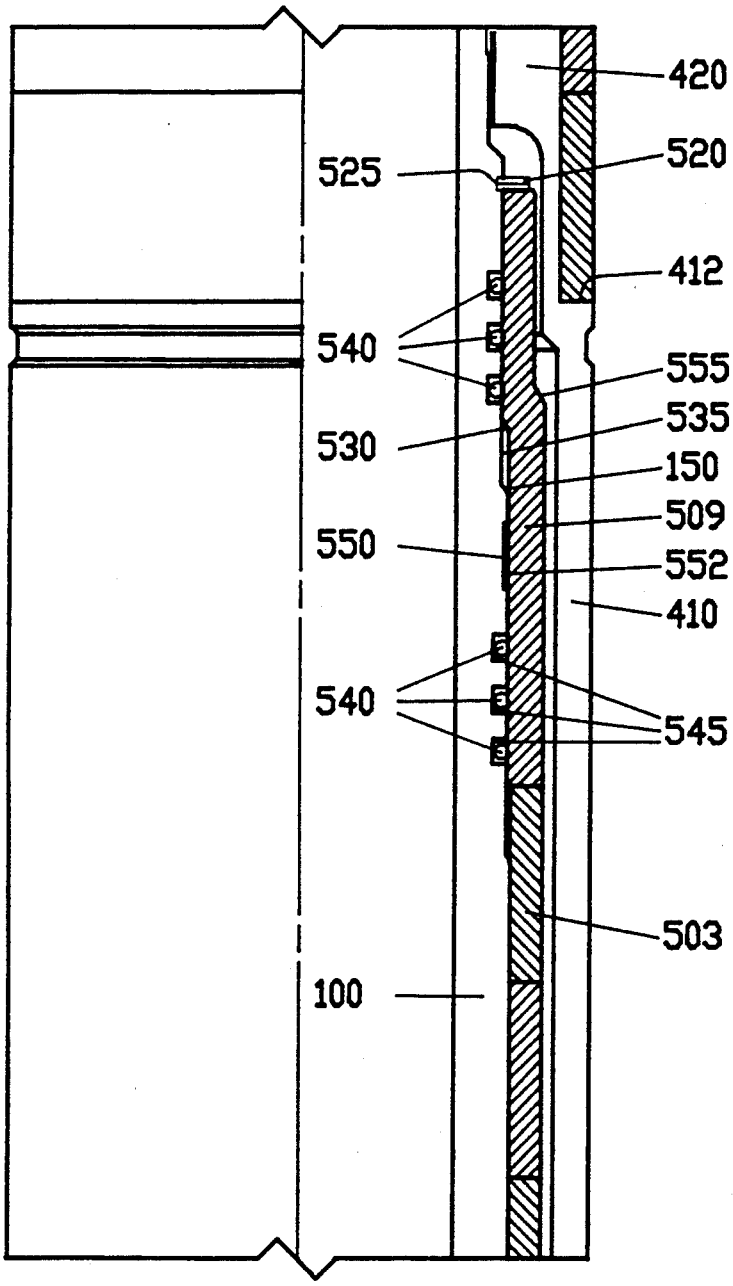
FIG. 3 is an enlarged partial cross-section of the hydrostatic driver shown in FIG. 2.

Referring now to FIG. 2, the upper end of blast joint A has upper housing 400 composed mainly of upper housing slips sleeve 405, tongs skirt 410, coupling 420 and top collar 430. Coupling 420 has lower joint threads 422 and upper joint threads 424 with lower joint threads 422 engaging inner pipe upper threads 130 to mount upper housing 400 on blast joint A. Upper joint threads 424 are provided to join blast joint A with the next uppermost joint of pipe or another blast joint. Attached to the lower end of coupling 420 is the upper end of tongs skirt 410 which extends downward around, and spaced outwardly from, inner pipe 100. The upper end of coupling 420 is joined to upper housing top collar 430 such as by the engagement between coupling collar threads 426 and top collar inner threads 432. Slips sleeve 405, tongs skirt 410, coupling 420 and top collar 430 have internal and external annular recesses which overlap. Arranged in these recesses are erosion resistant rings 500 with medium diameter rings 503 lying in the internal annular recess and large diameter rings 504 lying in the external annular recess in an overlapping fashion. Medium diameter rings 503 shown here are the upper extension of the stack of medium diameter rings 503 which extends beyond the upper end of lower housing 200 in a continuous stack. Hydrostatic driver ring 509, as shown in FIGS. 2 and 3, conforms to upper shoulder 150 which results from a reduced wall thickness of inner pipe 100 beginning immediately under upper threads 130. Large diameter rings 504 are held in the external annular recess by abutting external recess lower shoulder 412 and external recess upper shoulder 434.

Upper housing retainer snap ring 520 lies in the snap ring groove 525, partially protruding therefrom into a matching recess in upper housing coupling 420. Upper housing retainer snap ring 520 restricts upward movement of hydrostatic driver ring 509 and the medium diameter rings 503 and spacer ring 260 positioned between upper housing retainer snap ring 520 and second retainer split ring 255. The upper housing retainer snap ring 520 also insures that all such erosion resistant rings 500 are installed in a vertically continuous stack with no gaps between individual rings.

As shown in FIG. 3, hydrostatic driver ring 509 has, on its internal surface, shoulder 530 which conforms to the change in wall thickness of inner pipe 100. A chamber 535 is formed between shoulder 530 of driver ring 509 and upper shoulder 150 of inner pipe 100 having side walls formed by the external surface of inner pipe 100 and the internal surface of driver ring 509. A series of seals 540 are located both above and below the chamber 535 to effectively form a seal between the internal surface of driver ring 509 and the external surface of inner pipe 100, thus sealing off the chamber 535 from the external environment. The seals 540, preferably high temperature o-rings, are installed in seal grooves 545 which are formed in the exterior surface of the inner pipe 100. A tolerance ring 550 is installed in tolerance ring groove 552 which is positioned between the lower series of seals 540 and the chamber 535. The tolerance ring 550 is a corrugated friction ring which is included to provide additional holding force in the event either series of seals 540 fail to hold pressure after a period of time. A short distance below the lowermost seal 540, the inner pipe 100 increases in outer diameter to its standard diameter. The short distance between the change in diameter and the lowermost seal 540 provides a working travel area to allow the hydrostatic driver ring 509 to travel down when subjected to downhole pressure.

In use, the blast joint A utilizes the downhole pressure to apply a downward force on the erosion-resistant rings 500 positioned between the second retainer split ring 255 and the upper housing snap ring 520, thus eliminating any gaps between the adjacent erosion-resistant rings 500. The pressure around hydrostatic driver ring 509 is the downhole well pressure due to the annulus between the external surface of erosion-resistant rings 500 and the internal surface of the lower portion of the upper housing 400. This well pressure acts on the exposed top surface 550 and foot surface 555 of hydrostatic driver ring 509 while the pressure inside annular chamber 535 remains essentially at ambient. The hydrostatic driver ring 509 is permitted to advance downward thus eliminating any slack between the erosion resistant rings 500 by reducing the volume of the annular chamber 535. The driver ring 509 advances downward because the well pressure acting on the exposed top surface 550 and foot surface 555 multiplied by the effective area of those surfaces is greater than the ambient pressure found inside annular chamber 535 multiplied by the area of the inside end surfaces 150 and 530 of annular chamber 535. The pressure inside annular chamber 535 can increase slightly because of the reduction in volume of chamber 535 and because of the increase in temperature, but it will never approach the well pressure, which can be several thousand pounds per square inch. The hydrostatic driving force is necessary because of possible shifts of the blast joint protective sheath during handling and operation and because of the differing rates of thermal expansion which may be exhibited by the structural materials used in blast joint A and the erosion-resistant rings 500.

Figure 4:
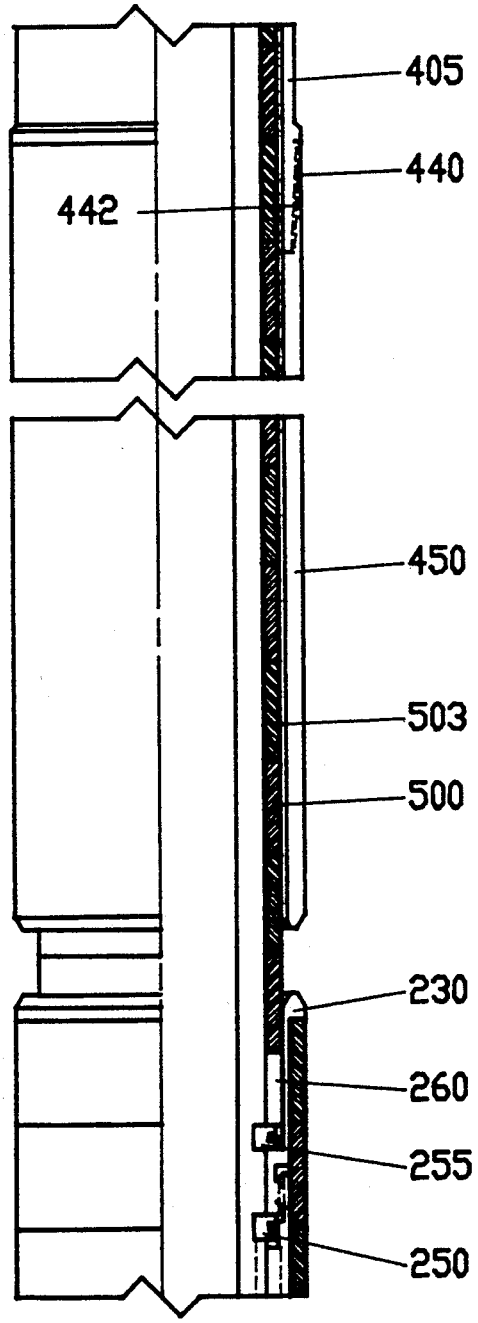
FIG. 4 is a partial cross-section of the mid-section of the blast joint having a snubbing pressure jacket attached to the upper housing.

In order to make the blast joint A adaptable for use with a snubber unit, a snubbing pressure jacket 450 having a smooth, continuous exterior surface is used along the mid-section of the blast joint A between the upper housing 400 and the lower housing 200 as shown in FIG. 4. The snubbing pressure jacket 450 is connected to the slips sleeve 405 of the upper housing 400. The slips sleeve 405 has lower threads 440 engaging inner threads 442 of the snubbing pressure jacket 450. Other means of connecting the snubbing pressure jacket 450 to the slips sleeve 405 may be used but the connection must be able to withstand wellhead pressure. The snubbing pressure jacket 450 could even be permanently connected, such as by welding, to the slips sleeve 405 but this would normally make assembly of the blast joint A much more difficult and labor intensive. The annulus between the external surface of erosion-resistant rings 500 and the internal surface of the snubbing pressure jacket 450 allows the well pressure to act on the hydrostatic driver ring 509 as described above. The length of the snubbing pressure jacket 450 required is a function of the snubber unit and the length of the blast joint A.

In the event the blast joint A is not going to be utilized with a snubber unit, the lower threads 440 of the slips sleeve 405 are not required and may be eliminated.

Assembly

The assembly of the blast joint A without the snubbing pressure jacket will now be described. This assembly procedure will begin at the upper end of the joint A and proceed to the lower end.

Beginning with FIG. 2, the two sets of seals 540 are first installed in seal grooves 545. The tolerance ring 550 is inserted in the tolerance ring groove 552 prior to hydrostatic drive ring 509 being installed over the upper end of inner pipe 100 and positioned over the sets of seals 540. The upper housing retainer ring 520 is installed in the retainer ring groove 525. The retainer ring limits the upward advancement of the hydrostatic drive ring 509. The upper housing slips sleeve 405, the tongs skirt 410 and the coupler 420 is next inserted over the end of inner pipe 100 until the lower joint threads 422 of the coupler 420 meet the upper pipe threads 130. Coupling 420 is then threaded onto upper pipe threads 130 of inner pipe 100 with upper housing slips sleeve 405 and tongs skirt 410 extending downward over the hydrostatic drive ring 509. Large diameter rings 504 are then installed over the upper end of coupling 420 until the lowermost ring 504 abuts external recess lower shoulder 412. Finally, upper housing top collar 430 is threaded onto the upper end of coupling 420 until erosion-resistant rings 500 are held in place with the uppermost ring 504 abutting external recess upper shoulder 434. When installed as described, tongs skirt 410 provides a surface for the use of power tools to hold blast joint A against angular movement while making up threads 424 with the inner pipe lower threads 140 of the next uppermost blast joint A, if one is needed. If the next uppermost joint is another blast joint, lower end ring 506 which extends from the lower end of lower housing 200 will extend underneath top collar 430 of the next lowermost blast joint providing an overlap between lower end ring 506 and uppermost large diameter ring 504 of the next lowermost blast joint.

Medium diameter erosion resistant rings 503 are then slipped over the lower end of inner pipe 100 and stacked vertically with the uppermost rings 503 being arranged in the internal annular recess in upper housing 400. The uppermost ring 503 will abut the lower surface of hydrostatic drive ring 509.

Referring now to FIG. 1, the medium diameter rings 503 are successively installed on inner pipe 100 until the required location of lower housing 200 is reached. Spacer ring 260, if required, is then installed on the bottom of the stack of medium diameter rings 503 followed by installation of second retainer split ring 255 into second retainer split ring groove 125. The spacer ring 260 selected should result in a continuous tight fit of all the rings 500 located between the second retainer split ring 255 and the upper housing snap ring 520. Prior to assembly of lower housing 200 onto blast joint A, lower housing locking collar 230 is first slid over the lower end of inner pipe 100 and slid until the internal recess shoulder 235 abuts the lower face of second retainer ring 255. The internal recess of the lower housing locking collar 230 will extend upwards beyond the spacer ring 260 and at least part of the lowermost erosion resistant ring 503. The lower housing first retainer split ring 250 is slipped over the lower end of inner pipe 100 until it rests in first split ring groove 120. The first and second retainer split rings 250 and 255 determine the longitudinal location of the lower housing relative to inner pipe 100. The lower housing locking collar 230 is permitted to rotate between the split rings 250 and 255 but is restricted to a very slight amount of longitudinal movement. Large diameter rings 504 are installed on the external surface of the lower housing locking collar 230 and also on the external annular recess 272 of the lower housing body 210. Lower housing splines 240 are then inserted into longitudinal pipe spline grooves 110. The number of splines 240 can vary depending upon pipe diameter; however, a typical number would be eight. Lower housing body 210 is then slipped over the lower end of inner pipe 100 and slid upwardly until its upper threads 214 abut the locking collar threads 234. The locking collar 230 is then rotated to engage the locking collar threads 234 with the upper threads 214 of the lower housing body 210. The threads are drawn up tight until there are no longer any gaps between the large diameter rings 504 in the external annular recess 272. During this installation, grooves on the interior of lower housing body 210 align with and slide over splines 240. The lower stack of small diameter, erosion-resistant rings 502 is then slid over the lower end of inner pipe 100, filling the internal annular recess in lower housing body 210. Lower end ring 506 is then slid over the lower end of inner pipe 100 until it abuts the lowermost small diameter ring 502 and it is held in place by threading lower housing end sleeve 220 into the lower end of body 210.

As described before, lower housing 200 and upper housing 400 provide surfaces suitable for the use of power tools without excessive damage to the blast joint. Rotational forces on lower housing 200 are transmitted to inner pipe 100 by means of splines 240. No such transfer of torque is necessary from upper housing 400 to inner pipe 100, since, while upper housing 400 is being held against rotation, the remainder of the blast joint simply hangs from threads 422 and 130.

Upper housing 400 also provides durable annular slips sleeve 405 for the engagement of slip teeth without allowing such teeth to contact erosion-resistant rings 500. Axial and radial forces from the slip teeth are transferred to inner pipe 100 through threads 130 and 422.

The assembly of the blast joint A with the snubbing pressure jacket is, as you might expect, quite similar to the above. The upper housing 400 is assembled as described above. The medium diameter erosion resistant rings 503 are then slipped over the lower end of inner pipe 100 until the stack of rings 503 approaches the lower end of the snubbing pressure jacket 450 when installed. The snubbing pressure jacket 450 is then slid over the lower end of the inner pipe 100 and the stack of erosion resistant rings 503 until the jacket 450 reaches the lower threads 440 of the slips sleeve 405. The snubbing pressure jacket 450 and the slips sleeve 405 are then threaded together. When installed as described, either the tongs skirt 410 or the slips sleeve 405 provides a surface for the use of power tools to hold the blast joint A against angular movement while rotating the snubbing pressure jacket 450 with power tools. Additional medium diameter erosion resistant rings 503 are then installed on the inner pipe 100 until the required location of the lower housing 200 is reached. At this stage the rest of the assembly of the blast joint A is the same as earlier described.

The embodiments described here are the preferred embodiments but it can easily be seen how details of construction of some of the components can be modified without changing the function of this invention. To the extent that all such modifications are equivalent, it is intended that they be encompassed within the following claims.

I claim:

1. A pipe joint resistant to erosion, comprising:

an inner pipe;

a cylindrical lower housing mounted on the inner pipe near a lower end of the inner pipe having a surface suitable for gripping with power tongs;

means for locating the lower housing longitudinally on the inner pipe;

means for securing the lower housing against angular movement relative to the inner pipe;

a cylindrical upper housing mounted on the inner pipe near an upper end of the inner pipe having a surface suitable for gripping with power tongs;

a plurality of internal and external annular recesses on the lower and upper housings, with the external recesses overlapping the internal recesses at their ends;

a plurality of erosion-resistant rings arranged in the internal and external annular recesses and between the housings concentrically with the inner pipe in a vertically continuous arrangement from a point near the lower end of the inner pipe to a point above the upper end of the inner pipe without a vertical gap between the erosion resistant rings; and means for hydrostatically imposing a vertical load on the plurality of erosion-resistant rings arranged between the upper and lower housings to prevent separations between the rings.

2. The pipe joint of claim 1, wherein the means for hydrostatically imposing a vertical load comprises:

an erosion resistant drive ring arranged concentrically with the inner pipe and located at the end of the plurality of erosion resistant rings arranged between the upper and lower housings, forming a sealed annular chamber between the drive ring and the external surface of the inner pipe, the sealed annular chamber is maintained at a relatively low pressure creating a pressure differential from outside the chamber to inside the chamber, to produce a force which acts downward on the drive ring and the plurality of erosion resistant rings below the drive ring;

wherein the sealed annular chamber includes one wall formed by the internal surface of the drive ring, one wall formed by the external surface of the inner pipe, and at least one seal between the two walls at two opposite ends.

3. The pipe joint of claim 2, further comprising:

a tolerance ring located between the internal surface of the drive ring and the external surface of the inner pipe to provide additional holding force in the event the pressure differential from outside to inside the annular chamber is lost.

4. The pipe joint of claim 3, wherein the cylindrical upper housing comprises:

a unitary housing having a first surface for gripping with power tongs and a second surface suitable for gripping with pipe slips.

5. The pipe joint of claim 4, further comprising:

a snubbing pressure jacket attached at a lower end of the cylindrical upper housing and extending downwardly around the inner pipe and outside the erosion resistant rings.

6. A pipe joint resistant to erosion, comprising:

an inner pipe;

a cylindrical lower housing mounted on the inner pipe near a lower end of the inner pipe having a surface suitable for gripping with power tongs;

means for locating the lower housing longitudinally on the inner pipe;

means for securing the lower housing against angular movement relative to the inner pipe;

a cylindrical upper housing mounted on the inner pipe near an upper end of the inner pipe including a unitary housing having a first surface suitable for gripping with power tongs and a second surface suitable for gripping with pipe slips, said cylindrical upper housing and said unitary housing monolithically formed as one unit;

a plurality of internal and external annular recesses on the lower and upper housings, with the external recesses overlapping the internal recesses at their ends;

a plurality of erosion-resistant rings arranged in the internal and external annular recesses and between the housings concentrically with the inner pipe in a vertically continuous arrangement from a point near the lower end of the inner pipe to a point above the upper end of the inner pipe without a vertical gap between the erosion resistant rings; and means for imposing a vertical load on the plurality of erosion-resistant rings arranged between the upper and lower housings to prevent separations between the rings.

7. A pipe joint resistant to erosion, comprising:

an inner pipe;

a cylindrical lower housing mounted on the inner pipe near a lower end of the inner pipe having a surface suitable for gripping with power tongs;

means for locating the lower housing longitudinally on the inner pipe;

means for securing the lower housing against angular movement relative to the inner pipe;

a cylindrical upper housing mounted on the inner pipe near an upper end of the inner pipe including a unitary housing having a first surface suitable for gripping with power tongs and a second surface suitable for gripping with pipe slips;

a plurality of internal and external annular recesses on the lower and upper housings, with the external recesses overlapping the internal recesses at their ends;

a plurality of erosion-resistant rings arranged in the internal and external annular recesses and between the housings concentrically with the inner pipe in a vertically continuous arrangement from a point near the lower end of the inner pipe to a point above the upper end of the inner pipe without a vertical gap between the erosion resistant rings; and means for imposing a vertical load on the plurality of erosion-resistant rings arranged between the upper and lower housings to prevent separations between the rings;

wherein the means for imposing a vertical load comprises an erosion resistant drive ring arranged concentrically with the inner pipe and located at the end of the plurality of erosion resistant rings arranged between the upper and lower housings, forming a sealed annular chamber between the drive ring and the external surface of the inner pipe, the sealed annular chamber is maintained at a relatively low pressure creating a pressure differential from outside the chamber to inside the chamber, to produce a force which acts downward on the drive ring and the plurality of erosion resistant rings below the drive ring;

wherein the sealed annular chamber includes one wall formed by the internal surface of the drive ring, one wall formed by the external surface of the inner pipe, and at least one seal between the two walls at two opposite ends.

8. A pipe joint resistant to erosion, comprising:

an inner pipe;

a cylindrical lower housing mounted on the inner pipe near a lower end of the inner pipe having a surface suitable for gripping with power tongs;

means for locating the lower housing longitudinally on the inner pipe;

means for securing the lower housing against angular movement relative to the inner pipe;

a cylindrical upper housing mounted on the inner pipe near an upper end of the inner pipe including a unitary housing having a first surface suitable for gripping with power tongs and a second surface suitable for gripping with pipe slips, said cylindrical upper housing and said unitary housing monolithically formed as one unit;

a plurality of internal and external annular recesses on the lower and upper housings, with the external recesses overlapping the internal recesses at their ends;

a plurality of erosion-resistant rings arranged in the internal and external annular recesses and between the housings concentrically with the inner pipe in a vertically continuous arrangement from a point near the lower end of the inner pipe to a point above the upper end of the inner pipe without a vertical gap between the erosion resistant rings;

means for imposing a vertical load on the plurality of erosion-resistant rings arranged between the upper and lower housings to prevent separations between the rings; and a snubbing pressure jacket attached at a lower end of the cylindrical upper housing and extending downwardly around the inner pipe and outside the erosion resistant rings.

* * * * *